US006199565B1

(12) United States Patent
Bluestone

(10) Patent No.: US 6,199,565 B1
(45) Date of Patent: Mar. 13, 2001

(54) MODULAR PARTS WASHING APPARATUS AND SERVICING METHOD

(76) Inventor: Ronald H. Bluestone, 2164 Rudolph Dr., Lake Havasu City, AZ (US) 86404

( * ) Notice: Subject to any disclaimer, the term of this patent is extended or adjusted under 35 U.S.C. 154(b) by 0 days.

(21) Appl. No.: 09/186,082

(22) Filed: Nov. 5, 1998

(51) Int. Cl.[7] ..... B08B 3/02

(52) U.S. Cl. ..... 134/108; 134/111; 134/186; 134/201

(58) Field of Search ..... 134/186, 111, 134/105, 108, 155, 110, 201

(56) References Cited

U.S. PATENT DOCUMENTS

| | | | | |
|---|---|---|---|---|
| 4,226,548 | * | 10/1980 | Reith | 134/111 |
| 4,505,284 | * | 3/1985 | Kyatt | 134/111 |
| 5,303,725 | * | 4/1994 | Hilgren | 134/111 |
| 5,464,533 | * | 11/1995 | Koslow | 134/111 |
| 5,478,465 | * | 12/1995 | Larson et al. | 134/111 |
| 5,513,667 | * | 5/1996 | Usher | 134/111 |
| 5,598,861 | * | 2/1997 | Danowski et al. | 134/111 |
| 5,649,557 | * | 7/1997 | Usher | 134/111 |
| 5,944,035 | * | 8/1999 | Chen | 134/111 |
| 5,950,647 | * | 9/1999 | Usher | 134/111 |
| 6,016,818 | * | 1/2000 | Evaro et al. | 134/111 |

FOREIGN PATENT DOCUMENTS

| | | | | |
|---|---|---|---|---|
| 454106 | * | 1/1949 | (CA) | 134/111 |
| 933412 | * | 1/1949 | (GB) | 134/111 |

* cited by examiner

*Primary Examiner*—Frankie L. Stinson
(74) *Attorney, Agent, or Firm*—Gregory J. Nelson

(57) ABSTRACT

A parts cleaner for removing oil, grease and contaminants from parts or items. The cleaner has a sink supported on a base. A modular housing containing a reservoir is removably positioned below the sink and includes a pump and electrical components. The pump is connected to a dispensing apparatus at the sink for delivery of cleaning solution. The sink drain communicates with the reservoir via a flexible line. The modular housing may be removed for servicing and servicing may be accomplished by replacing the removed modular housing with another previously serviced unit so the removed unit may be conveniently and environmentally safely serviced at a remote central servicing location.

8 Claims, 7 Drawing Sheets

MODULAR PARTS WASHING APPARATUS AND SERVICING METHOD

FIELD OF THE INVENTION

The present invention relates to an apparatus for washing items and more particularly relates to a sink-type apparatus for washing items such as automotive parts to remove grease, oil and other contaminants using a washing fluid which is nonflammable, biodegradable and environmentally acceptable. The invention also relates to a parts cleaner servicing system or method.

BACKGROUND OF THE INVENTION

Sinks and similar apparatus for removing grease and oils from parts such as automotive parts are widely used and can be found in most automotive and machine shops.

In the past, parts washers of the sink type utilized toxic cleaning fluids such as petroleum-based solvents and non-biodegradable detergents. The use of such toxic cleaning solutions is environmentally objectionable and, as a result, both State and Federal Regulations either restrict or severely limit the use of these types of solutions. For example, California has passed environmental regulations effective Jan. 1, 1999 which prohibit the use of certain classes of solvents in part washing machines. Accordingly, there has developed a need for environmentally acceptable parts washers which utilize safe, biodegradable cleaning solutions and which are nevertheless effective to remove accumulated grime, particularly hydrocarbon-based contaminants such as oil and grease and which is both simple to use, convenient to service and which complies with local, state and federal environmental regulations.

As indicated above, there are a number of parts washers in the prior art. In the industry, a cabinet type washer has an enclosure which houses a spray system and the cabinet is closed during operation. A sink-type device has an open tub and the parts are cleaned manually using a brush in a bath of cleaning solution. U.S. Pat. No. 5,398,708 discloses a parts cleaning machine which has a cabinet with a rotating carousel for supporting articles to be cleaned. A sink is also provided which receives cleaning fluid from the spray bar network in the cabinet. The cabinet includes a reservoir in the bottom which collects fluid sprayed by the spray bar network.

InstaClean, Inc. of Lake Havasu City, Ariz. also offers a line of degreasers which include a cabinet. The InstaClean IC4 parts cleaner has a large load capacity for accommodating large parts such as transmission cases, engine blocks and the like. This machine is designed to use a nonflammable, biodegradable cleaning compound which is dispersed by a manifold within the cabinet.

Other parts cleaning machines are also available in the prior art such as those manufactured by Landa Water Cleaning Systems as shown in Catalog #96-250.

The patent literature discloses a number of parts washers including the following:

| | |
|---|---|
| U.S. Pat. No. 2,570,021 - Beach | U.S. Pat. No. 4,824,567 - Turman |
| U.S. Pat. No. 2,746,467 - Dempsey | U.S. Pat. No. 4,855,023 - Clark |
| U.S. Pat. No. 2,771,086 - Kearney | U.S. Pat. No. 4,869,820 - Yee |
| U.S. Pat. No. 2,834,359 - Kearney | U.S. Pat. No. 4,954,222 - Durr |
| U.S. Pat. No. 2,842,143 - Kearney | U.S. Pat. No. 5,080,791 - Sims |
| U.S. Pat. No. 3,079,286 - Kearney | U.S. Pat. No. 5,271,850 - Stutzman |
| U.S. Pat. No. 3,085,948 - Kearney | U.S. Pat. No. 5,273,060 - Hill |
| U.S. Pat. No. 3,120,853 - Kearney | U.S. Pat. No. 5,349,974 - Mansur |
| U.S. Pat. No. 4,157,096 - Miller | U.S. Pat. No. 5,360,027 - Harman |
| U.S. Pat. No. 4,379,467 - Purr | U.S. Pat. No. 5,398,708 - Sheldon |
| U.S. Pat. No. 4,392,891 - Meyers | U.S. Pat. No. 5,402,806 - Hakeem |
| U.S. Pat. No. 4,651,762 - Bowden | U.S. Pat. No. 5,417,851 - Yee |
| U.S. Pat. No. 4,784,169 - Striedieck | |

BRIEF SUMMARY OF THE INVENTION

Briefly, the present invention provides a sink type parts cleaning device and servicing system method. The cleaning apparatus includes a sink mounted on a base. The sink has a central drain and cleaning solution is dispersed at a valved fitting above the sink through a tee. One outlet of the tee is connected to a flexible hose which terminates at a handle having a brush which is adapted to be manually used to clean parts. The other outlet of the tee is connected to a flexible line which can be configured and re-configured into different shapes and positions. The end of the configurable line terminates at a nozzle to allow the nozzle to direct fluid at a part within the basin in a hands-free operation so the mechanic may use a wire brush or other cleaning tool in conjunction with the cleaning fluid.

A modular housing encloses a reservoir to which is attached a mechanical enclosure which contains a pump, electrical connections and other components. The reservoir is removable from beneath the housing and the reservoir receives the spent or used cleaning fluid from a drain in the sink. The only connection between the modular reservoir and the basin is a drain hose from the sink and the discharge from the pump which is connected via a line with a quick connect coupling. The flexible discharge hose communicates fluid from the sink to a location within the reservoir below the normal fluid level in the reservoir into a filter basket in the top of the reservoir. The pump withdraws fluid returned from the sink to the reservoir for re-use and directs the fluid through a discharge line to a valved tee fitting above the sink. The pump inlet is below the normal fluid level in the reservoir. A thermostat controls the operation of an electric heating element to maintain the temperature of the fluid at an appropriate temperature as for example 115° F. A float provides the user with a visual indication of the fluid level in the reservoir.

The reservoir and attached electrical and mechanical components are part of a modular housing and are removable from beneath the sink housing. The modular construction greatly facilitates servicing as periodically when the recycled cleaning fluid becomes contaminated, the unit can be serviced in several ways. The modular housing containing the reservoir can be removed from the base and can be emptied at the site by pumping the spent fluid into a container for removal and replacing the spent fluid with clean, fresh cleaning solution. Alternatively, the modular housing can be removed along with the spent fluid and the entire module containing fresh cleaning solution can be replaced with a new module and appropriately connected to the parts basin and a source of power. In this way, the modular housing containing the reservoir and contaminated solution can safely and conveniently be removed from the location and taken to a central servicing location where the fluid can be removed and the module cleaned and replenished with new cleaning solution. Servicing at a central location is efficient and makes it easier to comply with safe handling of environmentally acceptable standard practices.

A primary object of the present invention is to provide a parts washing sink with a removable and replaceable modular reservoir which greatly facilitates cleaning and servicing of the unit.

Another object of the present invention to provide a parts washing sink which is simple and effective and easy to use.

Yet another object of the invention is to provide a part washing sink which meets environmental standards and which uses nonflammable, biodegradable cleaning solution.

BRIEF DESCRIPTION OF THE DRAWINGS

The above and other objects and advantages of the present invention will become more apparent from the following description, claims and drawings in which:

DESCRIPTION OF THE PREFERRED EMBODIMENT

Figure 1:
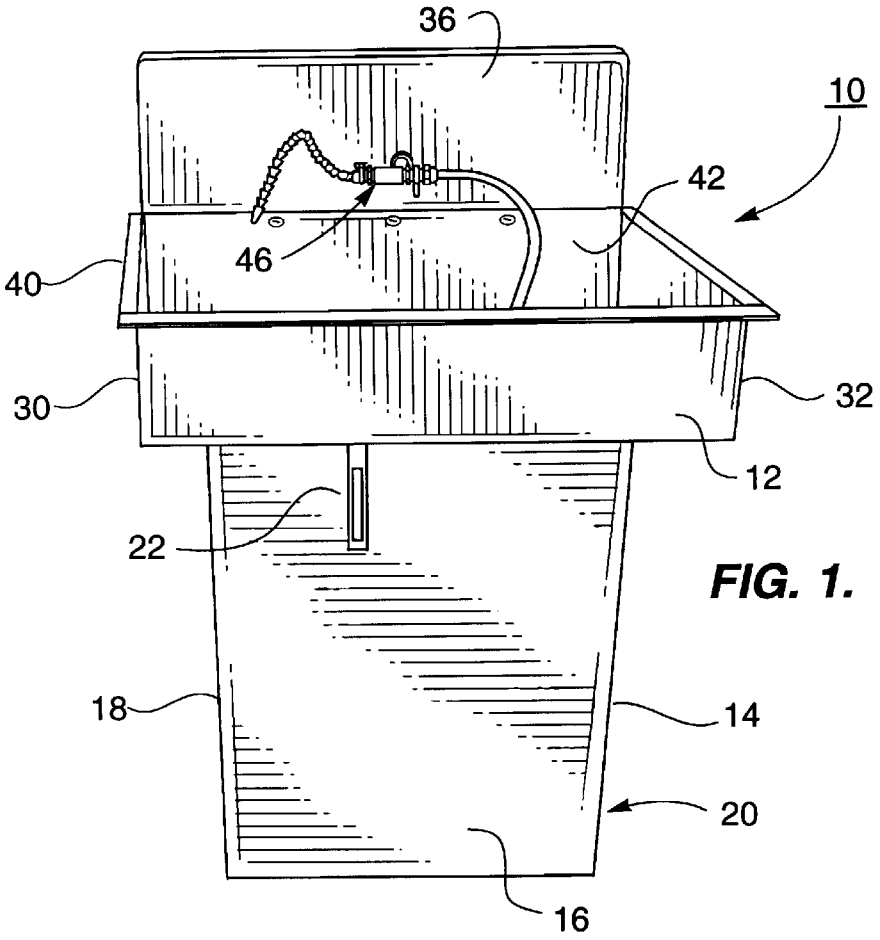
FIG. 1 is a perspective view of the parts cleaning apparatus of the present invention.

Referring now to the drawings, the parts cleaning apparatus of the present invention is generally designated by the numeral 10 and includes a base 14 having a sink 12 supported on the base 14. The sink is at a convenient elevation for access normally about 28" to 36' above the floor. The base 14 has a front wall 16 and opposite side walls 18 and 20. The front and opposite side walls are generally rectangular and fabricated from a heavy gauge steel. The rear of the base is open to facilitate servicing as will be more fully explained hereafter. The front wall 16 defines a vertical slot 22 which provides the user a visual indication of the water level within the reservoir as will be explained below.

The sink 12 may be of any convenient depth, typically 8' to 12'. The sink 12 has a front wall 28, opposite side walls 30, 32 and rear wall 34 which has a vertical extension 36 which serves as a back splash. The sink, as shown, has a peripheral extending lip 40 and a liner 42 which is a steel or other material which will resist wear and the effects of harsh chemicals and corrosion.

Figure 2:
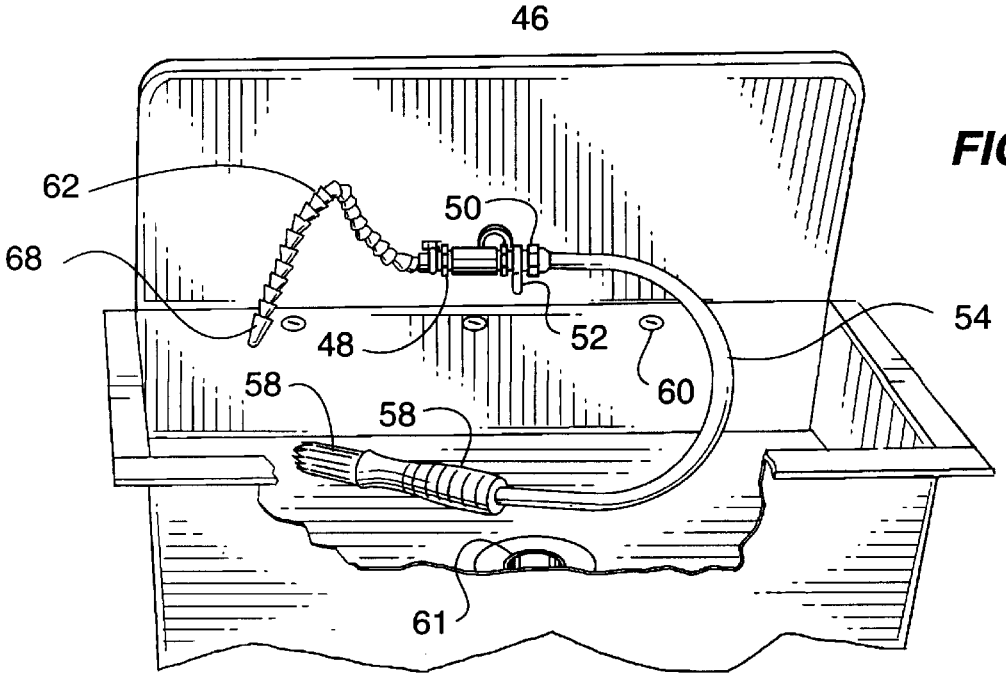
FIG. 2 is a detailed view of the sink portion of the parts cleaner as indicated in FIG. 1.

The parts cleaning or washing fluid is directed to the sink through tee connection 46 which has opposite outlets 48 and 50. Outlet 50 is connected across valve 52 to flexible hose 54, as best seen in FIG. 2. Flexible hose 54 terminates at a handle 56 which has a brush 58 extending from its outer end. In use, the mechanic may direct a regulated flow of cleaning solution to the brush 58 by adjustment of valve 52. Items to be cleaned are placed into the sink or held over the sink and manually cleaned by brushing the parts using the brush 58. The flow of cleaning solution through the brush 58 will assist in removing contaminants and will serve to flush the contaminants from the sink to the drain 60. Alternatively, a flow of cleaning fluid can be directed by adjustment of valve 48 through conduit 62. Conduit 62 can be configured to direct a flow of cleaning fluid from nozzle 68 to a desired location within the basin. As best seen in FIG. 2, the conduit 62 is flexible and is comprised of a series of interconnecting link elements 70 which allow the conduit to be configured and reconfigured in a wide variety of shapes as required by the user. There are a number of configurable flexible conduits of this type which may be used for this application. This design allows hands-free operation as a part can be placed in the sink and the flexible conduit adjusted so that the nozzle directs a stream onto the part or item to be cleaned. The stream will flush away contaminants and the user may also use brush 58 or another cleaning tool such as a wire brush to assist in removing contaminants. Drain 60 includes a conventional basket-type strainer to catch large debris and particles to prevent them from returning to the reservoir. Preferably, the strainer is constructed so it can not be closed.

Figure 6:
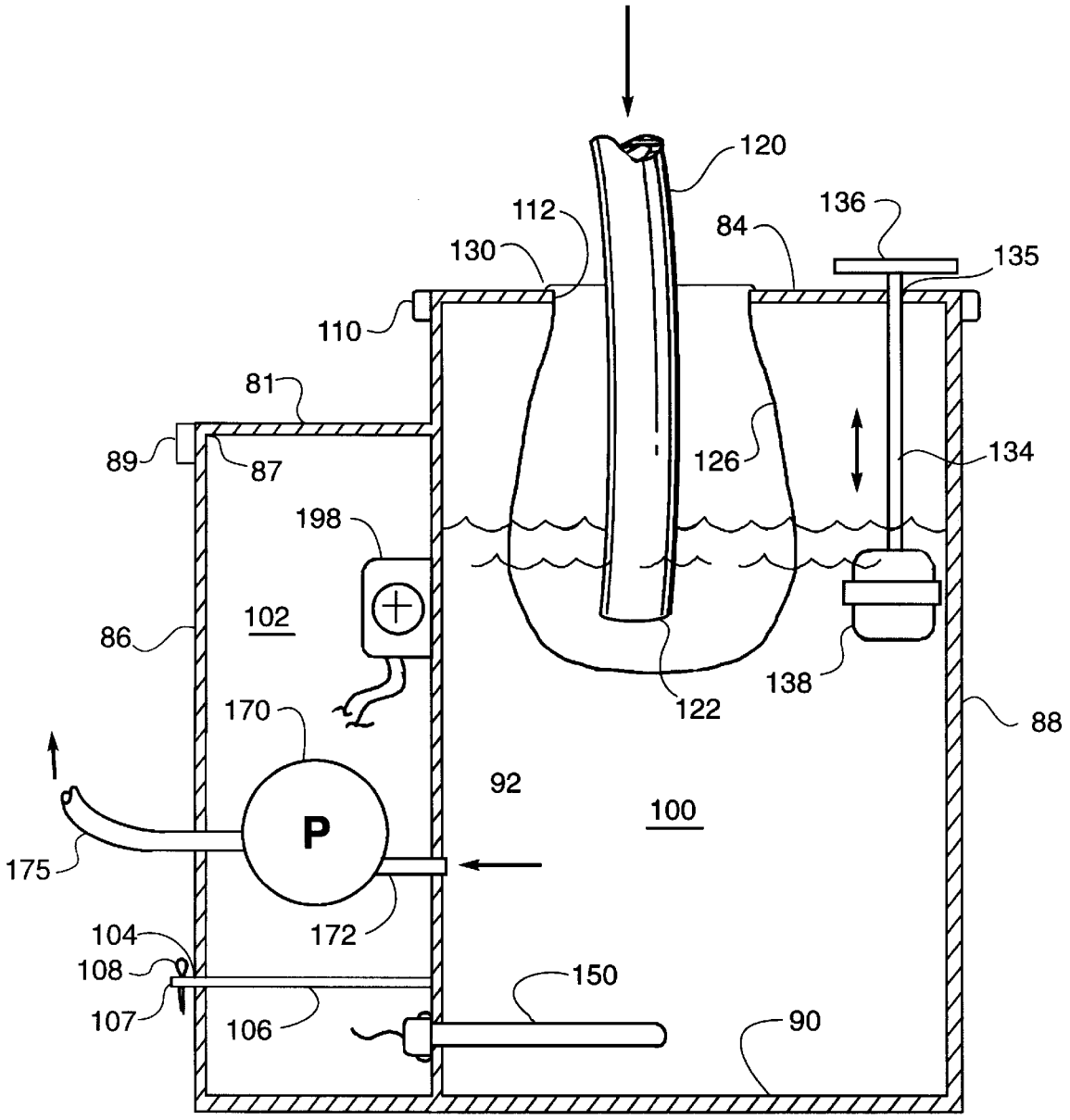
FIG. 6 is a sectional view taken along line 6—6 of FIG. 5.
Figure 7:
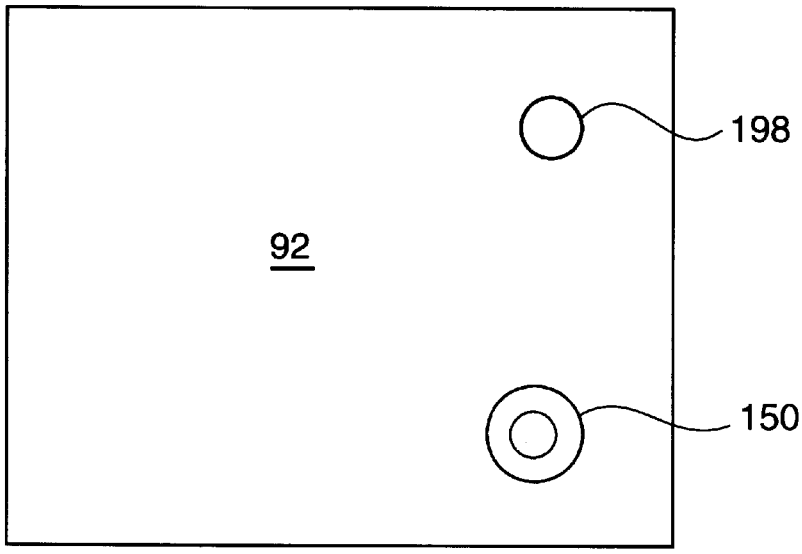
FIG. 7 is a sectional view taken along line 7—7 of FIG. 6.
Figure 8:
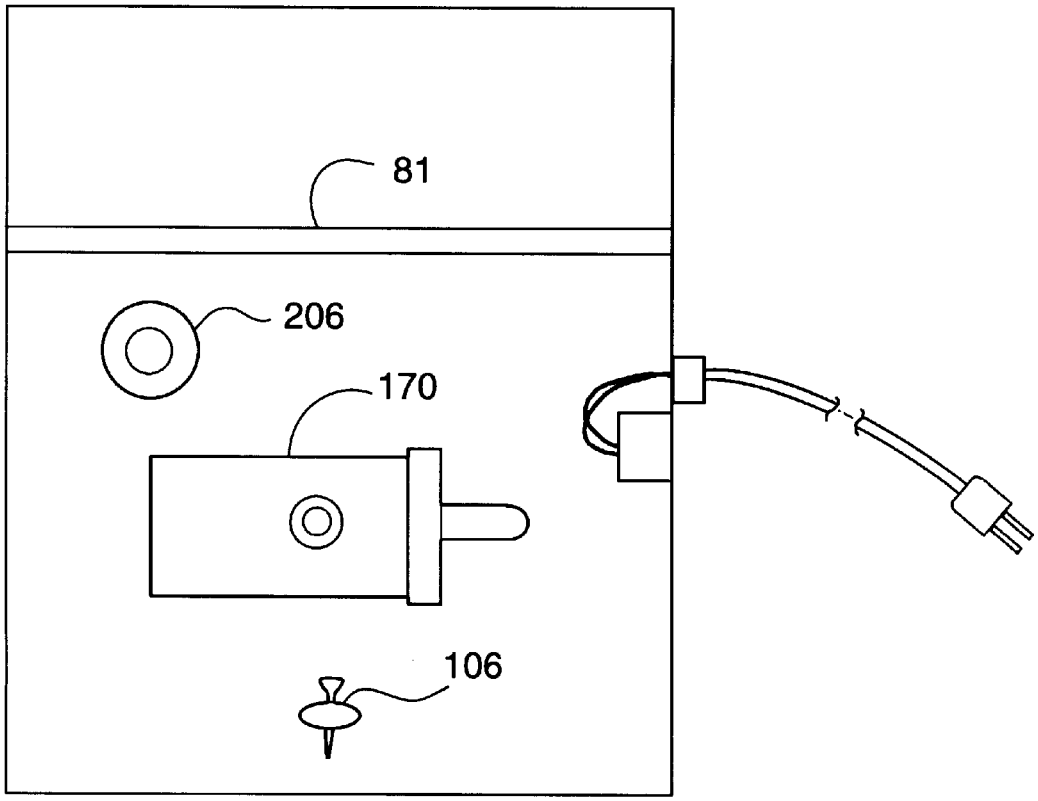
FIG. 8 is a sectional view taken along line 8—8 of FIG. 6.

Referring to FIGS. 3, 4, 5, 6 and 7, the rear of the housing is shown along with the modular reservoir housing. The modular reservoir housing is designated by the numeral 80 and includes a rear wall 82, front wall 84, opposite side walls 86, 88 and bottom wall 90. A baffle 92 extends from top wall 84 to the bottom wall 90 and separates the housing into a reservoir chamber 100 and an adjacent mechanical component section 102, as best seen in FIG. 6. Side wall 86 has an upper edge 87 which fits beneath a lip 89 extending along the edge of top wall 84 of the pump housing. Side wall 86 defines an aperture 104 through which rod 106 extends horizontally from side wall 92 where it is secured. The outer end of rod 106 defines a vertical bore 107 which receives a retainer shown as a cotter pin 108. Thus, the side wall 86 of the component section 102 can be removed to access the section 102 for purposes of maintenance and servicing the mechanical and electrical components therein.

The top or cover 84 of the reservoir chamber 100 may be removed and to facilitate removal, the cover is provided with a plurality of hangers 110 which hangers support the cover. Thus, the cover can be simply lifted off to provide access to the reservoir chamber 100. The top cover 84 defines a large circular opening 112 which receives drain hose 120. The upper end of drain hose 120 is connected to the drain 60 in the basin. Drain hose 120 is flexible and depends through opening 112 into the reservoir 100 a sufficient distance so that the outlet end 122 of the drain hose is located well below the normal water level "WL" within the reservoir 100. A removable filter bag 126 also depends into the reservoir and the drain hose is positioned within the filter bag. The filter bag may be any suitable material such as a fabric mesh having a mesh size in the approximate range of 20 to 60 to collect and retain larger particles. The bag is removable and is supported by a ring 130 which engages the upper surface of cover 82. The bag can be simply lifted from the reservoir for purposes of cleaning or replacement if necessary.

A float provides an indication of the water level "WL" within the reservoir. As mentioned previously, the front wall 16 defines an opening 22. The float assembly includes a float element 132 which is attached to a vertical rod 132 which rod extends through an opening 135 in the cover. The upper end of the rod carries a flag-like indicator 136 which when the reservoir module is positioned within the housing is visible through the opening 22. Suitable graduations may be provided adjacent the opening 22 for reference indicating the level in the reservoir.

The reservoir unit is positioned below the basin within the housing and preferably rests on a pair of spaced-apart rails 140, 141. The rails facilitate removal and installation of the reservoir by allowing the reservoir module to be manually slid along the rails to position the module below the basin or to remove it for servicing.

Figure 9:
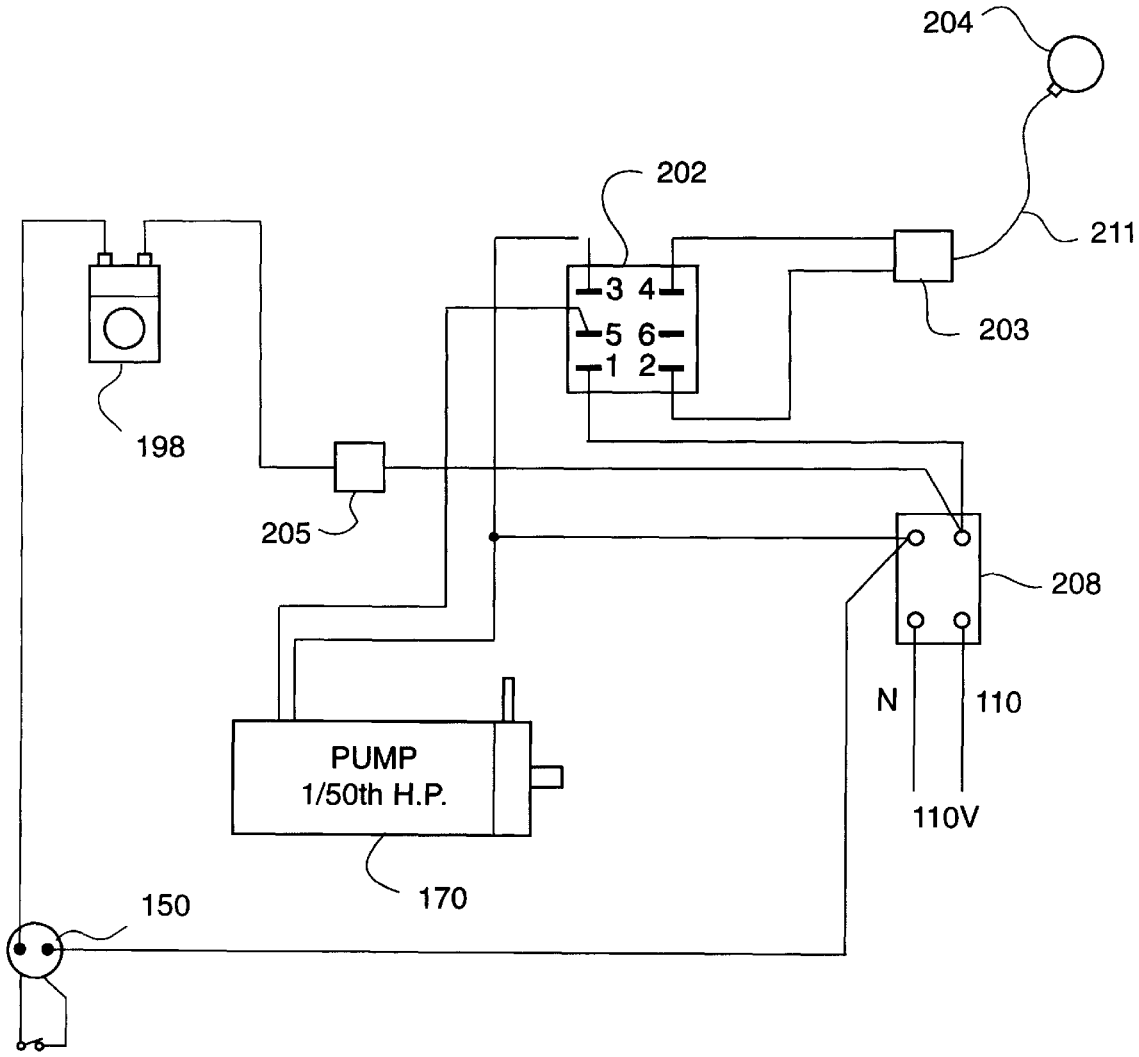
FIG. 9 is a schematic diagram of the electrical system.

As indicated above, the reservoir contains a suitable cleaning solution such as water and nonflammable, biodegradable detergents such as that manufactured by Golden West and sold under the trademark Insta-Clean IC-25. The effectiveness of the cleaning solution is enhanced by heating the solution to a suitable temperature, as for example around 115° F. Heating is accomplished by heating element 150 which is shown as an electric resistance heating element that extends into the reservoir at a location above the floor of the reservoir. The thermostat is supported on wall 92 and the opening around the thermostat is sealed. The thermostat 206 is connected to a source of electrical energy as indicated in FIG. 9. The thermostat 206 controls the temperature of the fluid within the reservoir. Pump and motor assembly 170 is mounted within the pump chamber 122. The pump and motor assembly are preferably a magnetic type of sealess construction such as the type of motor sold by Little Giant under the designation Cat. No. 58 1930. For most applications, the pump will range between 1-10th and 1-100th horsepower. The pump 170 has an inlet 172 which extends through panel 92 into the reservoir 100 at an intermediate elevation within the fluid well below the fluid level. The pump, when actuated, withdraws fluid and discharges it through discharge conduit 175 which is a flexible conduit which is connected to the discharge tee 46. The distal end of conduit 175 is preferably connected to the tee at a suitable connection 176 so that the hose can be easily disconnected when necessary. A hose clamp or quick connect coupling 176 works well for this purpose.

The return of drained fluids to a location below the normal fluid level and the withdrawal of fluid by the pump at a location below the drain return greatly helps to coalesce the oil and grease allowing them to float to the surface so that the fluid at the level at which the pump is connected is somewhat clarified rather than emulsified so that cleaner solution is recycled.

FIG. 9 is a schematic of the electrical components. Pump 170 is connected to a source of power such as a 110 VAC across-ground false interrupter 208. The pump is operable by means of foot pedal 204 which is connected by air line or air conduit 211 to air pressure switch 203 such as the type manufactured by Tridelta Industries. Upon depression of the foot pedal, the air switch 203 is activated starting the solid state timer 202. The timer will energize the pump motor for a predetermined period of time with two minutes being typical. The pump 170 will withdraw heated washing fluid from the reservoir 100 and direct it through conduit 175 to tee 46 at the rear of the sink. The user can then operate one of the valves 48, 52 associated with the tee and direct cleaning fluid either through the hand-held brush 56 or the reconfigurable flexible hose 62 as required. When the timer times out, the pump motor will cease operation and can be re-started by simply depressing the foot pedal 204. Thermostat 106 is set at a suitable temperature as for example 115° F. The thermostat 206 within the tank will sense a decrease in temperature and will cause the heating element to be energized heating the fluid in the reservoir. The high limit switch 205 will disconnect the heater and pump when the temperature exceeds the set point temperature, as for example 120° F.

Figure 3:
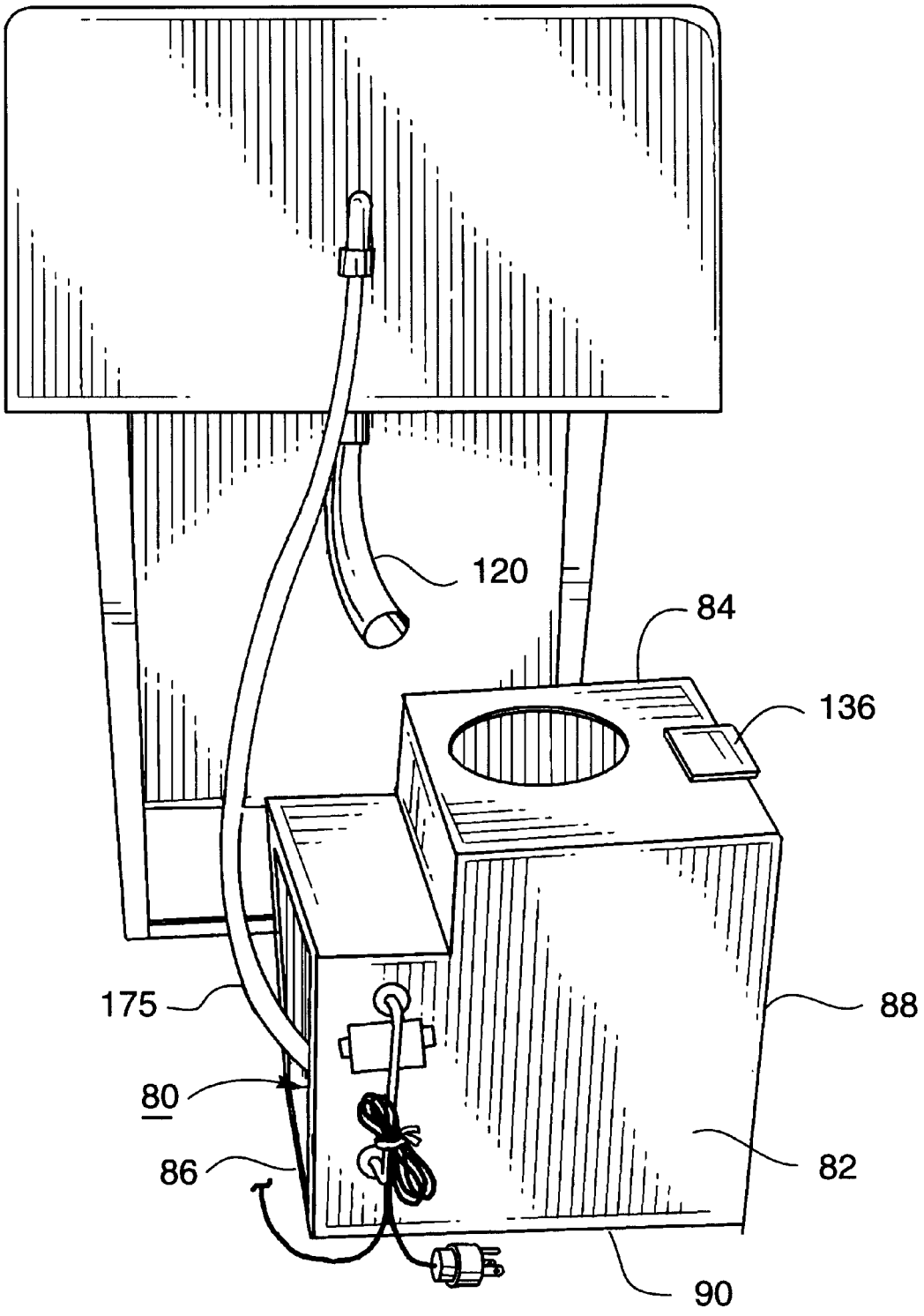
FIG. 3 is a rear perspective view of the parts cleaner of the present invention with the reservoir module removed.
Figure 4:
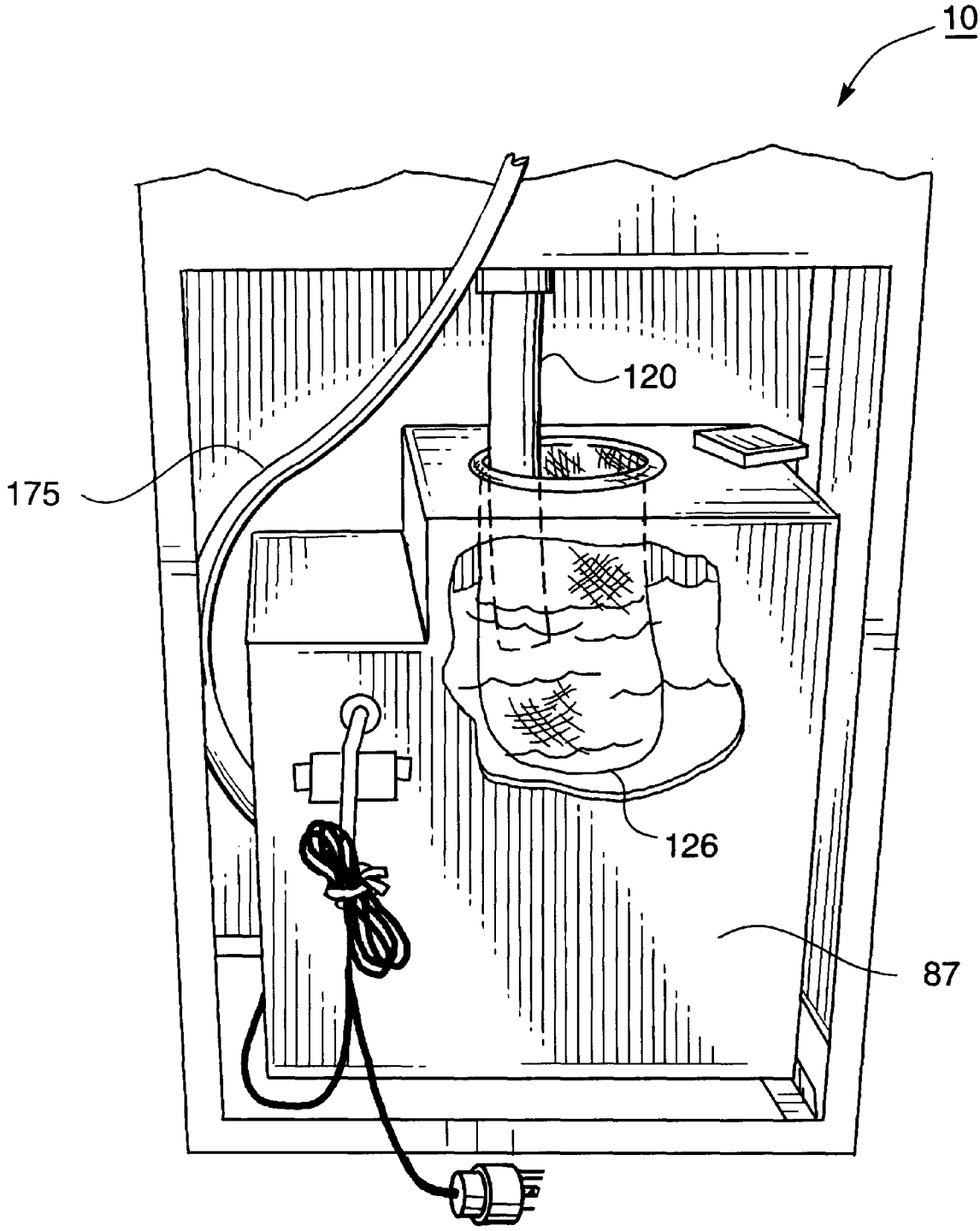
FIG. 4 is a view similar to FIG. 3 with the reservoir module positioned within the base of the parts cleaner below the sink.
Figure 5:
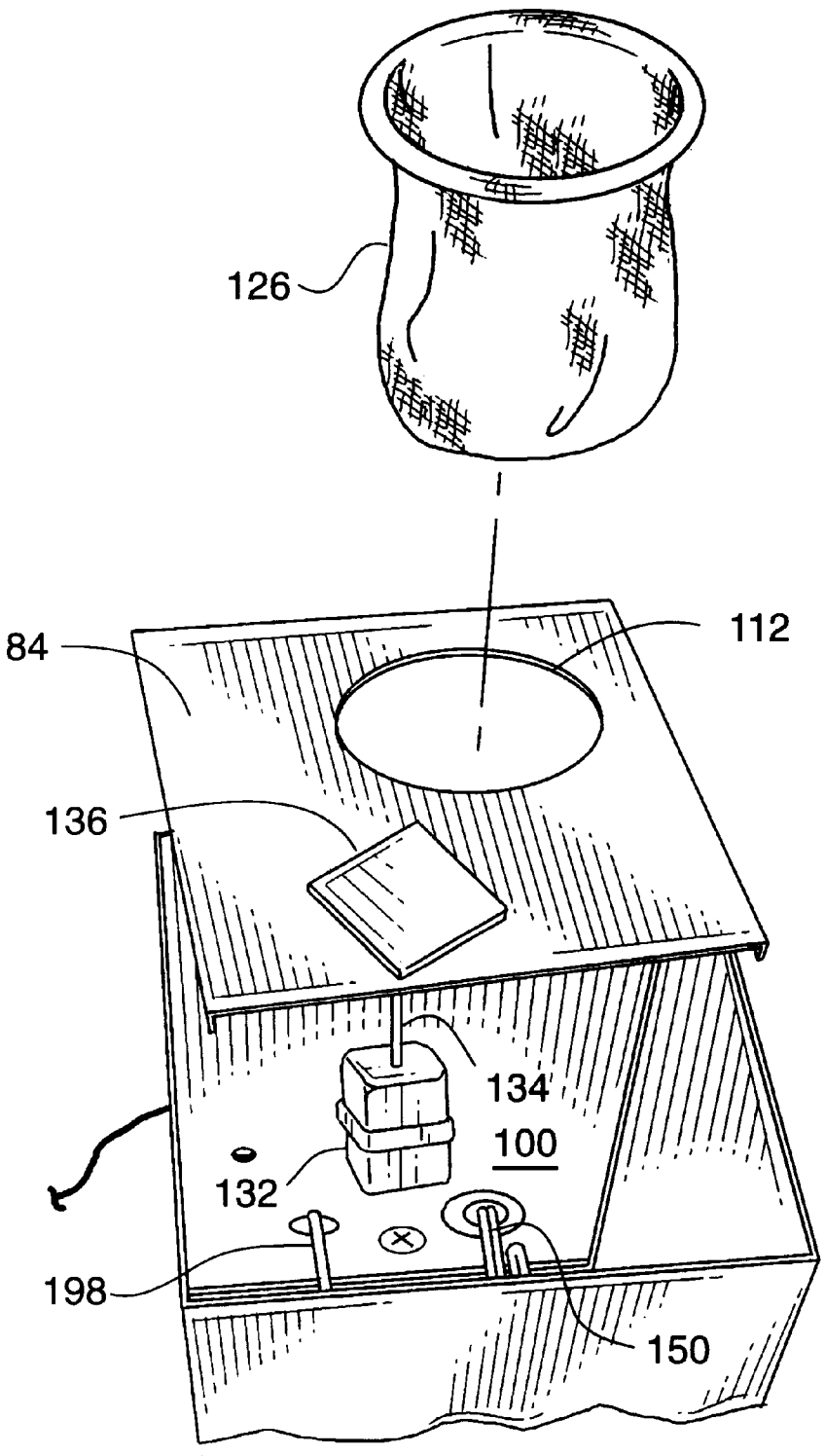
FIG. 5 is a top perspective view of the reservoir module with the top cover removed.

As pointed out above, an important aspect of the present invention resides in the effectiveness of the washer both in cleaning parts and facilitating servicing repair and maintenance. Repair is facilitated as the reservoir module may be easily accessed by sliding it rearwardly along the rails 140, 141 at the rear of the unit so that it is removed. Wheels or rollers may be provided on the module or rails to further facilitate removal and replacement of the module. The flexibility of the drain hose and the supply hose also facilitate the removal and installation of the module. FIG. 3 shows the reservoir module removed from the rear of the housing. Note that the flexible drain hose 120 will withdraw from the reservoir as the reservoir is removed from the housing. With the reservoir in the position shown in FIG. 3, the unit can be easily serviced. Over a period of time the washing fluid will become contaminated and will need to be replaced. Particulates will collect within the filter bag. Thus, servicing can be accomplished by removing the reservoir module to the position shown in FIG. 3. Removing the filter bag 126 and cleaning and flushing it and thereafter the contaminated washing fluid can be extracted from the reservoir by using an external pump. The washing fluid can then be replaced with fresh washing fluid and the module re-positioned within the housing beneath the sink in the position shown in FIG. 4.

While servicing as described above can be practiced, the modular system also permits convenient servicing by removing and disconnecting the existing reservoir module and replacing the existing module 80 with a fresh module containing clean filter and solution. Thus, a service person would have a designated route and at each location would provide service by removing the existing reservoir module and replacing it with a module that has been fully serviced. The new module could be transported from a service vehicle to the parts washer location by a hand truck or cart. The replaced module would be transported to the service truck where it would be loaded and taken to a central servicing location, drained, cleaned, serviced and replenished with clean washing solution. The serviced module 80 would then be ready as a replacement unit in a parts washer sink. The centralized cleaning is efficient and more environmentally acceptable as recovered oils and contaminants can be safely stored for recycling or removal to a certified disposal area.

The advantage of this system is that servicing in this manner is extremely efficient as the service person is only required to remove a module and replace it with a new one. Draining and cleaning can be accomplished at a central location especially equipped for this purpose. The spent or used washing solution can be collected in the tank and disposed of and treated in an environmentally acceptable manner. Spillage is minimized and spent fluid does not have to be disposed of at the location of the parts washer. The service person can service a large number of units efficiently and quickly and in an environmentally safe manner. In addition, if there are other service requirements such as replacement of electrical component, pump or motor, this can be done at the central service location. Thus, the present invention comprehends not only the unique parts cleaning apparatus described above but a servicing system for parts cleaning devices of this type.

Although the invention has been described as a parts cleaner for primary application in automotive shops, machine shops and the like, it will be understood that the cleaner can be used in numerous other environments such as restaurants, industrial applications and other situations where items are to be cleaned using detergents or other cleaners.

It will be obvious to those skilled in the art to make various changes, alterations and modifications to the parts cleaning system and device of the present invention. To the extent such changes, alterations and modifications do not depart from the spirit and scope of the appended claims, they are intended to be encompassed therein.

I claim:

1. A parts washer for cleaning contaminants from parts using a cleaning fluid, said parts washer comprising:

(a) a base;

(b) a sink supported on said base at an elevation to define a storage area below the sink, said sink having a bottom with a drain and dispensing means for delivery of cleaning fluid to parts within the sink;

(c) a modular housing removably positioned in said storage area beneath the sink, said housing including a reservoir defining a normal fluid level with a filter depending into said reservoir, said housing including a cabinet for mechanical components with said cabinet having an opening to access said cabinet interior;

(d) a pump located in said cabinet, said pump having an inlet communicating with said reservoir and an outlet;

(e) a flexible drain conduit extending between said drain and said reservoir to a normal depth below the normal fluid level within said filter;

(f) a flexible discharge conduit extending between said pump outlet and said dispensing means for directing fluid to parts in the sink whereby said modular housing may be removed from said base for servicing and maintenance.

2. The parts washer of claim 1 wherein said reservoir includes a filter and wherein said drain conduit terminates in said filter at a location below the normal fluid level in the reservoir.

3. The parts washer of claim 1 wherein said pump is electrically connected to a foot operable switch.

4. The parts washer of claim 1 wherein said base includes rails and modular housing is slidably removable from said storage area along said rails.

5. The parts washer of claim 1 wherein said dispensing means includes a tee having a first valved outlet connected to a flexible hose and a second valved outlet connected to a deformable and reformable hose.

6. The parts washer of claim 5 wherein said flexible hose terminates at a brush and said deformable and reformable hose terminates at a nozzle.

7. The parts washer of claim 1 wherein said reservoir includes a thermostatically controlled heating element.

8. The parts washer of claim 1 wherein said flexible discharge conduit includes a quick connect coupling.

* * * * *